US011492862B2

(12) United States Patent
Sehsah et al.

(10) Patent No.: US 11,492,862 B2
(45) Date of Patent: Nov. 8, 2022

(54) CUTTING PIPES IN WELLBORES USING DOWNHOLE AUTONOMOUS CUTTING TOOLS

(71) Applicant: Saudi Arabian Oil Company, Dhahran (SA)

(72) Inventors: Ossama R. Sehsah, Dhahran (SA); Amjad Shaarawi, Khobar (SA); Chinthaka Pasan Gooneratne, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 113 days.

(21) Appl. No.: 17/010,628

(22) Filed: Sep. 2, 2020

(65) Prior Publication Data

US 2022/0065061 A1 Mar. 3, 2022

(51) Int. Cl.
*E21B 29/00* (2006.01)
*E21B 47/092* (2012.01)
(Continued)

(52) U.S. Cl.
CPC ..... *E21B 29/002* (2013.01); *E21B 23/01* (2013.01); *E21B 23/06* (2013.01); *E21B 34/066* (2013.01);
(Continued)

(58) Field of Classification Search
CPC .. E21B 31/00–20; E21B 29/00; E21B 29/002; E21B 29/005
See application file for complete search history.

(56) References Cited

U.S. PATENT DOCUMENTS 2,110,913 A 3/1938 Lowrey
2,690,897 A 10/1954 Clark
(Continued)

FOREIGN PATENT DOCUMENTS

NO 20151342 4/2017
WO WO1995035429 12/1995
(Continued)

OTHER PUBLICATIONS

PCT International Search Report and Written Opinion in International Appln. No. PCT/US2021/048912, dated Dec. 3, 2021, 15 pages.

*Primary Examiner* — Kristyn A Hall
(74) *Attorney, Agent, or Firm* — Fish & Richardson P.C.

(57) ABSTRACT

A downhole autonomous cutting tool and methods are described. The downhole autonomous cutting tool including: a body comprising a hydraulic motor, the body having a generally cylindrical configuration such that the body limits a downhole flow of fluids past the autonomous cutting tool between the autonomous cutting tool and the pipe when the tool is deployed in the pipe; a locking unit attached to the body, the locking unit actuable to engage inner surfaces of the pipe in the wellbore; a sensor module operable to detect interactions between the pipe and walls of the wellbore; an actuation unit attached to the body and rotatable by the hydraulic motor, the actuation unit operable to move a plurality of cutting elements between a running position and a cutting position; and a control unit in electronic communication with the sensor module, the locking unit, and the actuation unit.

18 Claims, 15 Drawing Sheets

(51) Int. Cl.

| | |
|---|---|
| ***E21B 47/095*** | (2012.01) |
| ***E21B 23/01*** | (2006.01) |
| ***E21B 23/06*** | (2006.01) |
| ***E21B 34/06*** | (2006.01) |
| ***E21B 44/00*** | (2006.01) |

(52) U.S. Cl.
CPC ..... *E21B 44/00* (2013.01); *E21B 47/092* (2020.05); *E21B 47/095* (2020.05)

(56) References Cited

U.S. PATENT DOCUMENTS

| | | | | |
|---|---|---|---|---|
| 2,822,150 | A | 2/1958 | Muse et al. | |
| 2,899,000 | A | 8/1959 | Medders et al. | |
| 3,220,478 | A | 11/1965 | Kinzbach | |
| 3,253,336 | A | 5/1966 | Brown | |
| 3,331,439 | A | 7/1967 | Lawrence | |
| 3,468,373 | A | 9/1969 | Smith | |
| 3,839,791 | A | 10/1974 | Feamster | |
| 5,012,863 | A | 5/1991 | Springer | |
| 5,018,580 | A | 5/1991 | Skipper | |
| 5,070,952 | A | 12/1991 | Neff | |
| 5,074,355 | A | 12/1991 | Lennon | |
| 5,987,385 | A | 11/1999 | Varsamis et al. | |
| 6,041,860 | A | 3/2000 | Nazzal et al. | |
| 6,378,627 | B1 | 4/2002 | Tubel et al. | |
| 6,827,145 | B2 | 12/2004 | Fotland et al. | |
| 7,013,992 | B2 | 3/2006 | Tessari et al. | |
| 7,063,155 | B2 | 6/2006 | Ruttley | |
| 7,757,757 | B1 | 7/2010 | Vroblesky | |
| 9,353,589 | B2 | 5/2016 | Hekelaar | |
| 9,617,815 | B2 | 4/2017 | Schwartze et al. | |
| 10,113,408 | B2 | 10/2018 | Pobedinski et al. | |
| 10,544,640 | B2 | 1/2020 | Hekelaar | |
| 2004/0089450 | A1 | 5/2004 | Slade | |
| 2005/0211429 | A1 | 9/2005 | Gray | |
| 2007/0251687 | A1 | 11/2007 | Martinez et al. | |
| 2009/0266544 | A1* | 10/2009 | Redlinger | E21B 34/12 166/298 |
| 2010/0258289 | A1 | 10/2010 | Lynde et al. | |
| 2012/0152543 | A1 | 6/2012 | Davis | |
| 2012/0186817 | A1 | 7/2012 | Gibson et al. | |
| 2016/0053566 | A1* | 2/2016 | Winkler | E21B 47/06 166/99 |
| 2016/0130931 | A1 | 5/2016 | Lou | |
| 2016/0356111 | A1* | 12/2016 | Castillo | E21B 31/107 |
| 2017/0198538 | A1 | 7/2017 | Hansen et al. | |
| 2017/0242146 | A1 | 8/2017 | Itskovich | |
| 2018/0171774 | A1 | 6/2018 | Ringer et al. | |
| 2019/0345779 | A1 | 11/2019 | Kennedy et al. | |
| 2019/0345816 | A1 | 11/2019 | Auchere | |
| 2021/0115747 | A1* | 4/2021 | Stokes | E21B 31/20 |

FOREIGN PATENT DOCUMENTS

| | | |
|---|---|---|
| WO | WO 9807955 | 2/1998 |
| WO | WO2004042185 | 5/2004 |
| WO | WO2007049026 | 5/2007 |
| WO | WO2007070305 | 6/2007 |
| WO | WO2020006333 | 1/2020 |

* cited by examiner

CUTTING PIPES IN WELLBORES USING DOWNHOLE AUTONOMOUS CUTTING TOOLS

TECHNICAL FIELD

The present disclosure generally relates to cutting tools and operations for use in a wellbore, more particularly downhole autonomous cutting tools and methods that can be used to locate and cut a stuck pipe in a wellbore.

BACKGROUND

Drill pipes may be employed to drill oil and gas wellbores. Collectively, when connected, they form one entity called the drill string. In some instances, the drill string may get "stuck" in the wellbore due to the shape of the hole, accumulation of cuttings, or differential pressure. In such an event, the drilling crew is unable to move the drill string down to continue drilling or pull the string out-of-hole.

Mechanical and hydraulic tools are used to free the drill string from the wellbore. Using chemicals (e.g., acids), or simply cutting of the drill string, pulling the freed part out of the hole, and continuing drilling "side-track" within the wellbore are ways to resolve the issue. Mechanical and hydraulic tools can be run downhole on a wire-line and typically rely on prior knowledge of the location of the "stuck" drill string.

SUMMARY

This specification describes downhole autonomous cutting tools and methods that can be used to locate and cut a stuck pipe in a wellbore. These tools are not supported from the surface and do not require prior knowledge of the "stuck" pipe location.

The tools and methods described in this specification provide an approach in which the downhole autonomous cutting tool is dropped or pumped down in a pipe (e.g., a drill pipe or a casing string) to reach the location of the "stuck" pipe and to perform pipe cutting without being supported from the surface (e.g., on a wire-line). This downhole autonomous cutting tool includes a sensor module. In operation, the cutting tool is dropped into drill pipe and moves downhole with fluid being pumped downhole. Once the sensor module detects the "stuck" location of the pipe, the cutting tool anchors itself near the "stuck" location and starts cutting the stuck pipe. The cutting tool can be mechanically or hydraulically actuated.

The cutting tool also includes a body with a hydraulic motor, a locking unit, an actuation unit, and a control unit. The hydraulic motor includes a rotor embedded inside a stator. Rubber baffles extend radially outward from the body to limit flow around the body. The locking unit extends from an uphole end of the hydraulic motor and includes slips or a packer element. The terms "uphole end" and "downhole end" are used to indicate the end of a component that would be uphole or downhole when a component is deployed in a wellbore rather indicating an absolute direction. The slips (or the packer element) are used to anchor the body in place and prevent motion and rotation.

The actuation unit extends on the downhole end of the hydraulic motor and is attached to the rotor part of the hydraulic motor. The actuation unit includes a plurality of cutting elements and a plurality of linear actuators which extend the cutting elements radially outward when cutting the "stuck" pipe. The structural arrangement between the hydraulic motor, the locking unit, and the actuation unit can include a number of variations. For example, the actuation unit and the locking unit can be positioned on the uphole end of the hydraulic motor; the actuation unit and the hydraulic motor can be positioned on the uphole end of the locking unit; and/or the actuation unit and the locking unit can be positioned on the downhole end of the hydraulic motor. The control unit of the body can be positioned below the locking unit and in electronic communication with the locking unit, the actuation unit, and the sensor module.

In use, the cutting tool is dropped downhole in a drill pipe and can travel towards the bottom hole assembly (BHA). The sensor module can include sensors, instrumentation and signal processing circuits, receivers, transmitters, connecting probes, and data storing and processing devices.

In some aspects, a downhole autonomous cutting tool configured to cut a pipe in a wellbore, the downhole autonomous cutting tool including: a body including a hydraulic motor, the body having a generally cylindrical configuration such that the body limits a downhole flow of fluids past the autonomous cutting tool between the autonomous cutting tool and the pipe when the tool is deployed in the pipe; a locking unit attached to the body, the locking unit actuable to engage inner surfaces of the pipe in the wellbore; a sensor module operable to detect interactions between the pipe and walls of the wellbore; an actuation unit attached to the body and rotatable by the hydraulic motor, the actuation unit operable to move a plurality of cutting elements between a running position and a cutting position; and a control unit in electronic communication with the sensor module, the locking unit, and the actuation unit, the control unit configured to: identify a location where interaction between the pipe and the walls of the wellbore limits downhole movement of the pipe based on output of the sensor module; actuate the locking unit to engage inner surfaces of the pipe in the wellbore; and operate the actuation unit to move the plurality of cutting elements from the running position to the cutting position.

In some aspects, a downhole autonomous cutting tool configured to cut a pipe in a wellbore, the downhole autonomous cutting tool including: a body comprising a hydraulic motor with a rotor embedded inside a stator; a locking unit attached to the body, the locking unit actuable to engage inner surfaces of the pipe in the wellbore; a sensor module operable to detect interactions between the pipe and walls of the wellbore; and an actuation unit with a plurality of cutting elements moveable between a running position and a cutting position, the actuation unit rotationally fixed to the rotor.

Embodiments of the downhole autonomous cutting tool can include one or more of the following features.

In some embodiments, the locking unit includes a packer. In some cases, the locking unit includes slips.

In some embodiments, the sensor module includes an acoustic transmitter oriented to send an acoustic signal radially outward relative to an axis of the tool. In some cases, the acoustic signal has a frequency of 20-30 kHz. In some cases, the sensor module further includes an acoustic receiver and the control unit is configured to identify the location where interaction between the pipe and the walls of the wellbore limits downhole movement of the pipe based on output of the sensor by a change in attenuation of the acoustic signal.

In some embodiments, the sensor module includes an electromagnetic transmitter oriented to generate magnetic field radially outward relative to an axis of the tool. In some cases, the sensor module further includes an electromagnetic receiver and the control unit is configured to identify the location where interaction between the pipe and the walls of the wellbore limits downhole movement of the pipe based on a difference between sensor outputs.

In some embodiments, the sensor module includes an ultrasonic sensor.

In some embodiments, the hydraulic motor includes a rotor embedded inside a stator and the actuation unit is rotationally fixed to the rotor. In some cases, the body further includes rubber baffles extending radially outward.

In some embodiments, the actuation unit includes a plurality of linear actuators attached to the plurality of cutting elements, each linear actuator operable to move an associated cutting element radially relative to an axis of the tool. In some cases, each of the cutting elements includes a milling knife.

In some aspects, a method for cutting a pipe in wellbores, the method includes: dropping a downhole autonomous cutting tool in a pipe, a downhole autonomous cutting tool controlled by a flow rate and configured to identify a location where interaction between the pipe and walls of the wellbore limits a downhole movement of the pipe; sensing the pipe with a sensor module until it reaches the location where interaction between the pipe and the walls of the wellbore limits a downhole movement of the pipe; receiving a signal from the sensor module with an identified location; sending a signal to open a main valve to allow flow through the downhole autonomous cutting tool; locking the downhole autonomous cutting tool in position relative to the pipe and preventing the tool from moving further downhole; sending a signal to an actuation unit to engage and extend a plurality of cutting elements outwards and initiate cutting of the pipe; and retrieving the cut pipe.

The downhole autonomous cutting tool can help to locate the "stuck pipe" point and cut the pipe in a single downhole trip. The downhole autonomous cutting tool operates without being supported from the surface (e.g., on a wire-line). This approach simplifies the process of cutting of the drill string and pulling the freed part out of the hole during drilling reducing lost operation time and total cost. Pumping down the autonomous cutting tool without being supported from the surface also eliminates time associated with waiting for wire-line units to arrive and the cost associated with each wire-line unit. The downhole autonomous cutting tool saves tripping time and eliminates the need for prior knowledge of the "stuck pipe" location.

The downhole autonomous cutting tool design provides economic advantages by eliminating cost and time needed to mobilize, rig-up, and operate a wire-line unit. These factors can result in improved and efficient drilling operations and reduced operating time from approximately a week to less than a day.

The details of one or more embodiments of these systems and methods are set forth in the accompanying drawings and the description below. Other features, objects, and advantages of these systems and methods will be apparent from the description and drawings, and from the claims.

DETAILED DESCRIPTION

This specification describes downhole autonomous cutting tools and methods that can be used to locate and cut a stuck pipe in a wellbore. These tools are not supported from the surface and do not require prior knowledge of the "stuck" pipe location. The tools and methods described in this specification provide an approach in which the downhole autonomous cutting tool is dropped or pumped down in a drill pipe to reach the location of the "stuck" pipe and to perform pipe cutting without being supported from the surface (e.g., on a wire-line). This downhole autonomous cutting tool includes a body and a sensor module. In operation, the cutting tool is dropped into drill pipe and moves downhole with fluid being pumped downhole. Once the sensor module detects the "stuck" location of the pipe, the cutting tool anchors itself near the "stuck" location and starts cutting the stuck pipe. The downhole autonomous cutting tool can be mechanically or hydraulically actuated.

Figure 1:
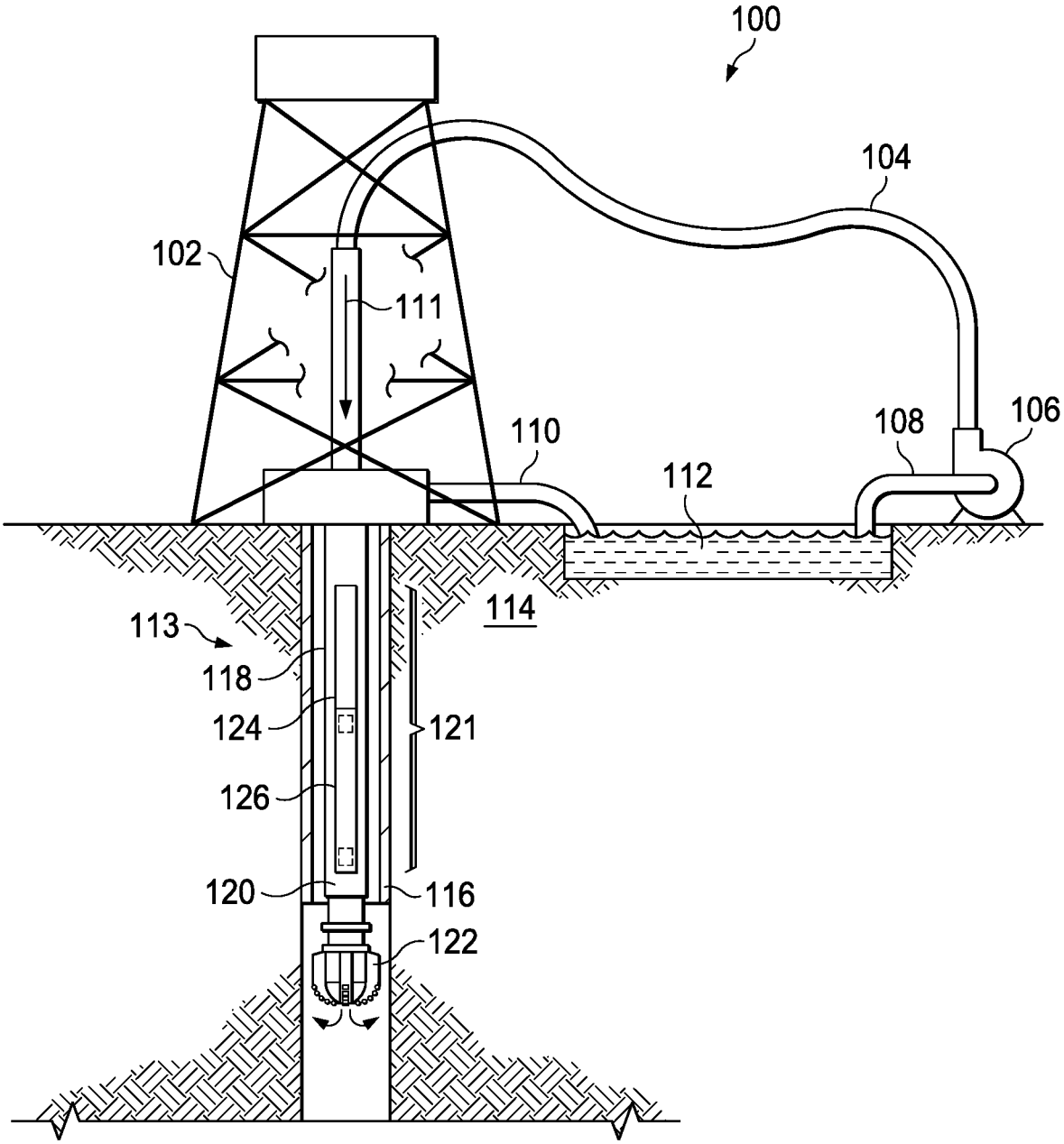
FIG. 1 is a schematic view of a drilling system including a downhole autonomous cutting tool.

FIG. 1 is a schematic view of a drilling system 100. The drilling system 100 includes a derrick 102 that supports a downhole portion 104 of the drilling system 100. The downhole portion 104 of the drilling system includes a drill string 106 formed of multiple connected drill pipes 107 and a drill bit 109 attached at the downhole end of the first drill pipe 107. The drilling system 100 is shown being used to drill a wellbore 108 into a subsurface formation 110. The wellbore 108 is illustrated as having a casing 112 but not all wellbores are cased.

A drilling fluid 114 (sometimes referred to as drilling mud) is pumped down the drill string 106 and returns up an annulus between the drill string 106 and walls of the wellbore 108. A circulation pump 116 draws drilling fluid 114 from a mud pit 118 and pumps the drilling fluid 114 into the drill string 106. Conduits 120 provide hydraulic connections between the circulation pump 116 and the drill string 106, between the wellbore 108 and the mud pit 118, and between the mud pit 118 and the circulation pump 116. The conduits can include hose, pipe, open channels, filters, or combinations of these components capable of handling the desired pressures and flowrates.

Sometimes during drilling, the drill string 106 gets stuck, for example, due to an accumulation of cuttings, due to differential pressure between the drill string 106 and the wellbore 108, or due to the geometry of the wellbore 108. When a drill string 106 gets stuck, the drilling crew is unable to move the drill string down to continue drilling, nor can they pull the string out-of-hole. FIG. 1 illustrates the drill string 106 in a stuck condition due to differential pressure.

FIG. 1 illustrates a downhole autonomous cutting tool 122 dropped into the drill string 106 to cut the drill string 106 near the location where the drill string 106 is stuck. As illustrated, the drilling fluid 114 being pumped down the drill string 106 is carrying the downhole autonomous cutting tool 122 down the drill string. The downhole autonomous cutting tool 122 is an independent unit string 106 tool 122 that includes a body 124 and a sensor module 126. In the illustrated tool, the body 124 and the sensor module 126 are attached to each another with the sensor module 126 positioned at the downhole end of the body 124. In some tools, the sensor module 126 is incorporated inside the body 124 of the tool. tool 122

Figure 2A:
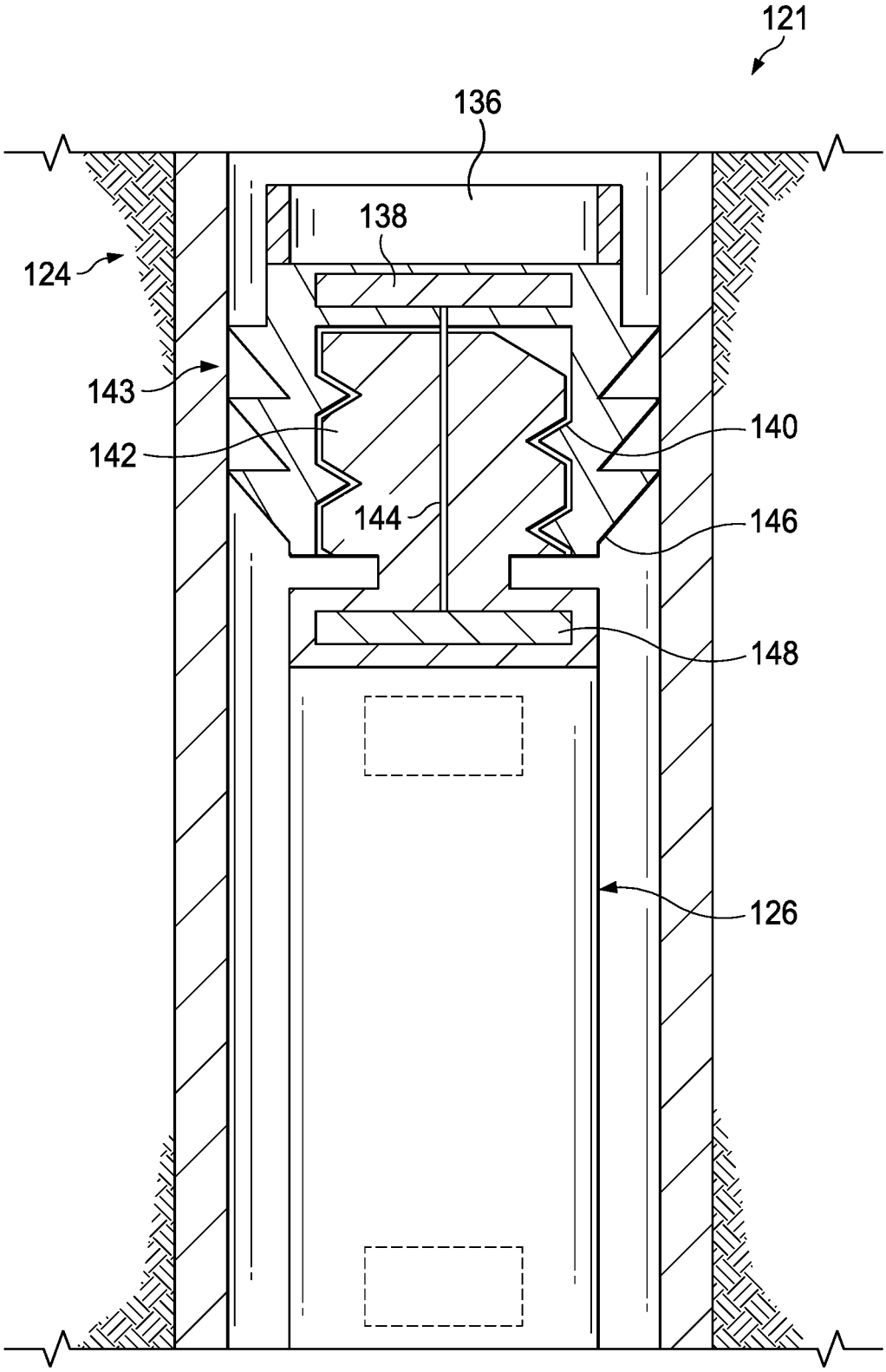
FIGS. 2A and 2B are schematic views of components in a downhole autonomous cutting tool.
Figure 2B:
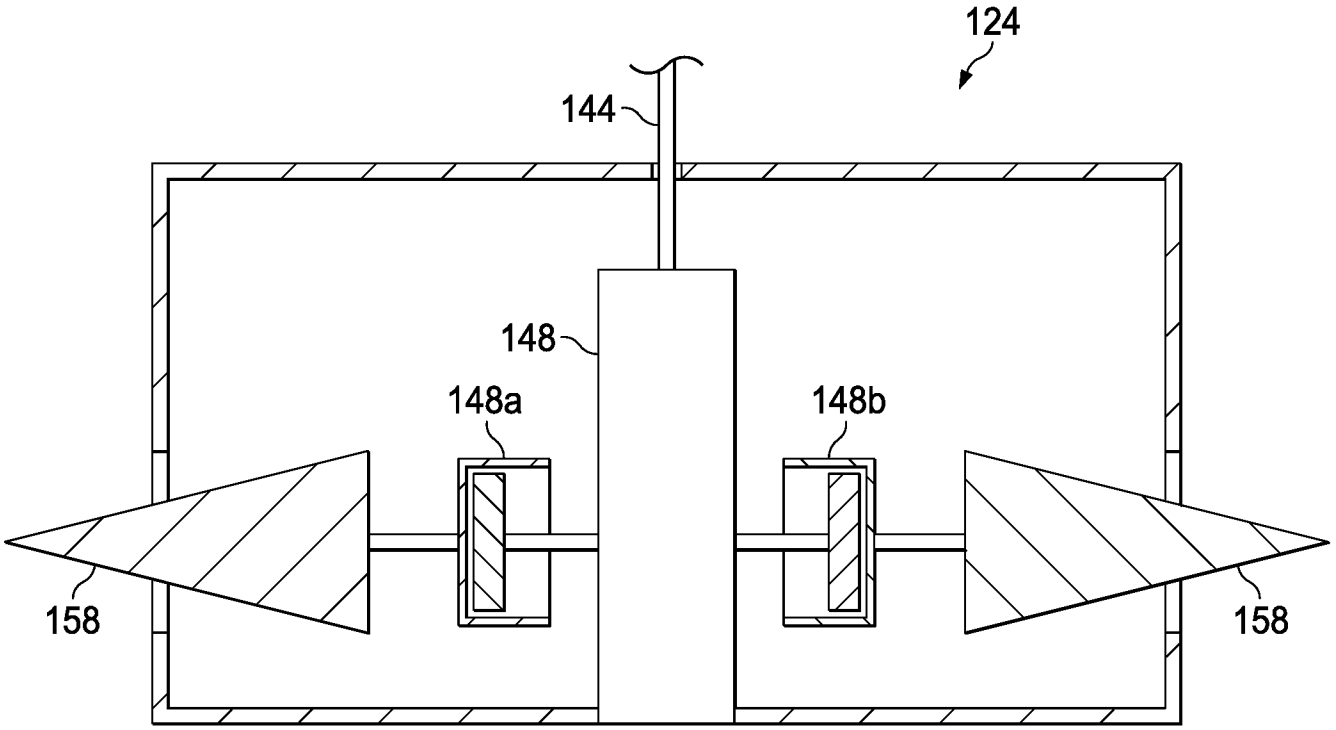

FIGS. 2A and 2B are schematic views of components of the downhole autonomous cutting tool 122. The body 124 and the sensor module 126 are mechanically attached to each other. For example, a female downhole end of the body 124 with internal threading receiving a male uphole end of the sensor module 126 with external threading. The body 124 includes a hydraulic motor 143, a locking unit 136, an actuation unit 148, and a control unit 138. The hydraulic motor 143 (e.g., a positive-displacement motor) has a generally cylindrical configuration. The body 124 includes external features that limit the downhole flow of the pumping drilling fluid 114 past the autonomous cutting tool 122. The cutting tool 122 includes rubber baffles 146 that extend radially outward that from the rest of the body 124. This configuration ensures that the autonomous cutting tool 122 will be carried downhole by drilling fluid being pumped through the drilling system 100 and directs the drilling fluid through the hydraulic motor 143 when the cutting tool 122 is locked in place in the drill string.

The hydraulic motor 143 is disposed inside of the body 124 and includes a rotor 142 embedded inside a stator 140. Flow of drilling fluid through the hydraulic motor 143 causes the rotor and the attached actuation unit to rotate.

The hydraulic motor 143 is attached to the locking unit 136. The locking unit 136 extends from an uphole end of the hydraulic motor 143 and includes slips or a packer element. The slips (or the packer element) are used to anchor the body 124 in place and prevent rotation of the body 124. The locking unit 136 engages the inner surfaces of the drill string 106 with the wall of the wellbore 108. In an example, the anchoring of the body is performed with a set of tapered elements that are forced against a rigid wall (e.g., a drill pipe or a casing) by releasing of pre-pressurized pistons. The tapered elements are positioned to provide upward and downward forces onto the tool and to keep the tool 122 fixed in position relative to the drill string 106. The hydraulic motor 143 is also attached to the actuation unit 148. The actuation unit 148 extends on the downhole end of the hydraulic motor 143. The actuation unit 148 includes a plurality of linear actuators 148*a*, 148*b* attached to a plurality of cutting elements 158 (shown in FIG. 2B). Each linear actuator 148*a*, 148*b* is operable to move an associated cutting element 158 radially relative to an axis of the cutting tool 122. Each of the cutting elements 158 can include a milling knife or a type of blade and can move between a running position and a cutting position.

The actuation unit 148 is attached to the rotor 142 such that rotation of the rotor rotates the actuation unit. The structural arrangement between the hydraulic motor, the locking unit, and the actuation unit can include number of variations. For example, the actuation unit and the locking unit can be positioned on the uphole end of the hydraulic motor; the actuation unit and the hydraulic motor can be positioned on the uphole end of the locking unit; or the actuation unit and the locking unit can be positioned on the downhole end of the hydraulic motor.

The locking unit 136, the actuation unit 148, and the sensor module 126 are in electronic communication with the control unit 138 via a communication channel 144. The control unit 138 receives an output from the sensor module 126 The output from the sensor module 126 may indicate the location where the drill string is stuck or the control unit 138 may interpret the output from the sensor module 126 to identify the location where the drill string is stuck. As previously discussed, where the drill string is stuck indicates a location where the interaction between the drill string 106 and walls of the wellbore 108 limits a movement of the drill string 106. A variety of events can impose limitations on the downhole movement of the drill string 106 at the contact interface between the drill string 106 and the wellbore 108.

Figure 3A:
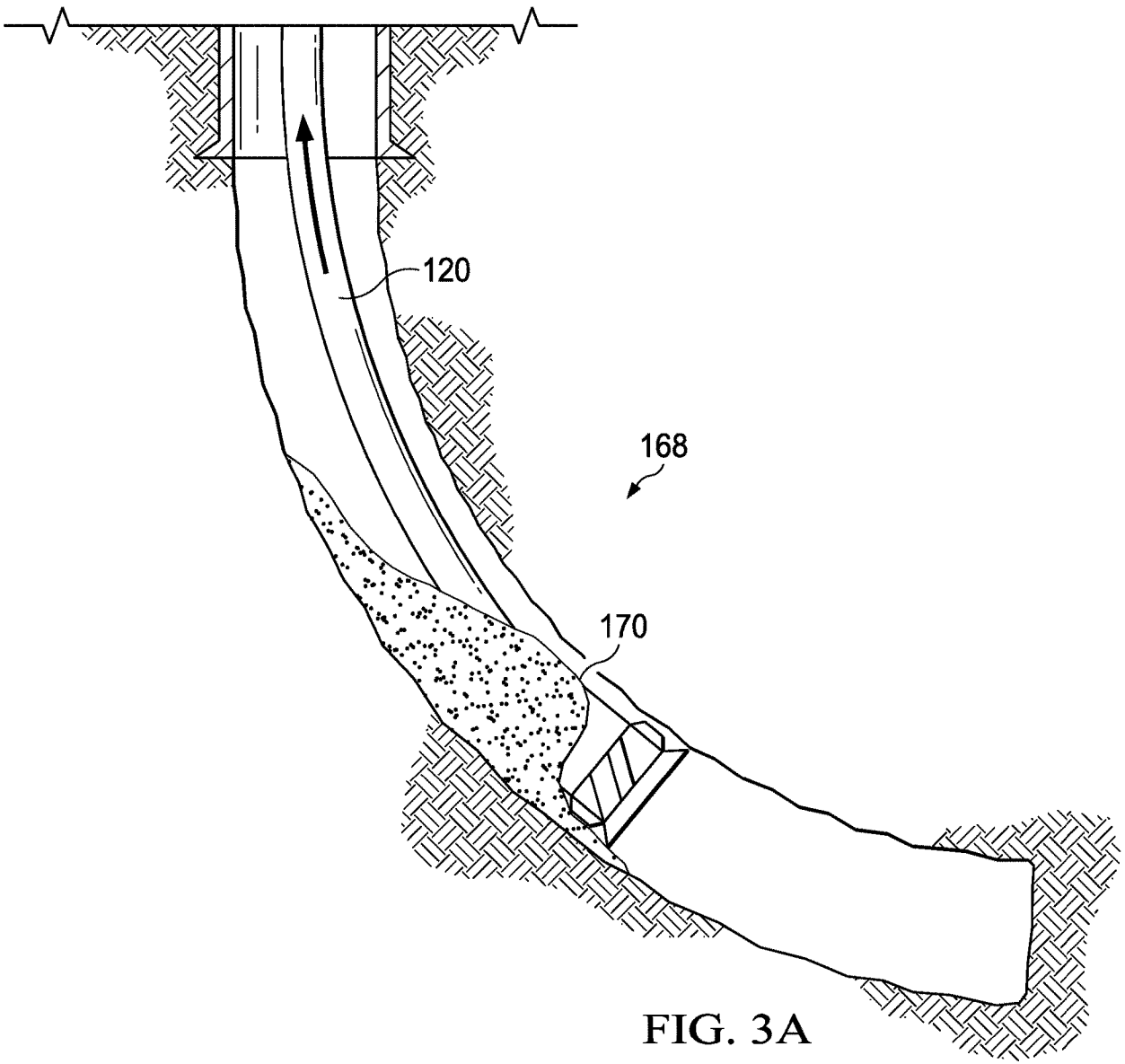
FIGS. 3A-3C are schematic views of different scenarios for a stuck pipe incident.
Figure 3B:
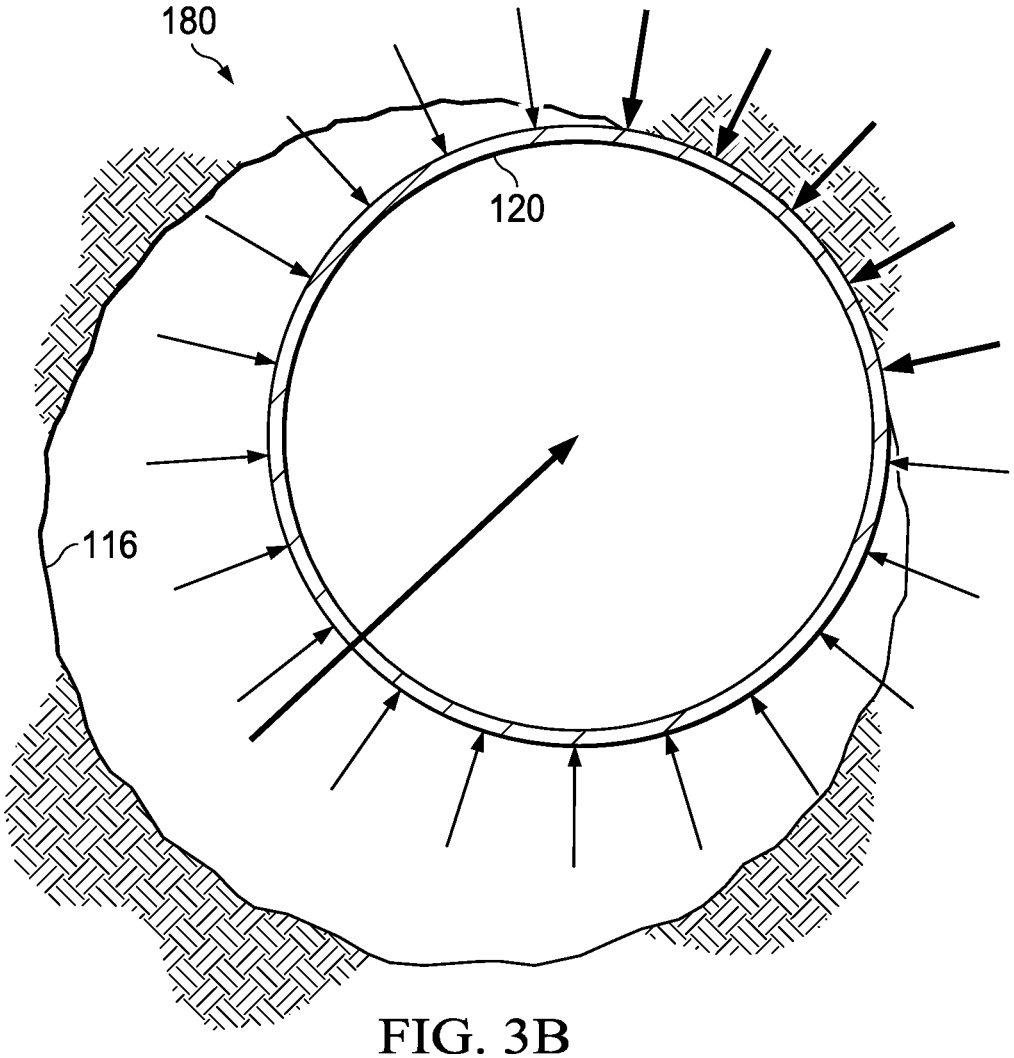
Figure 3C:
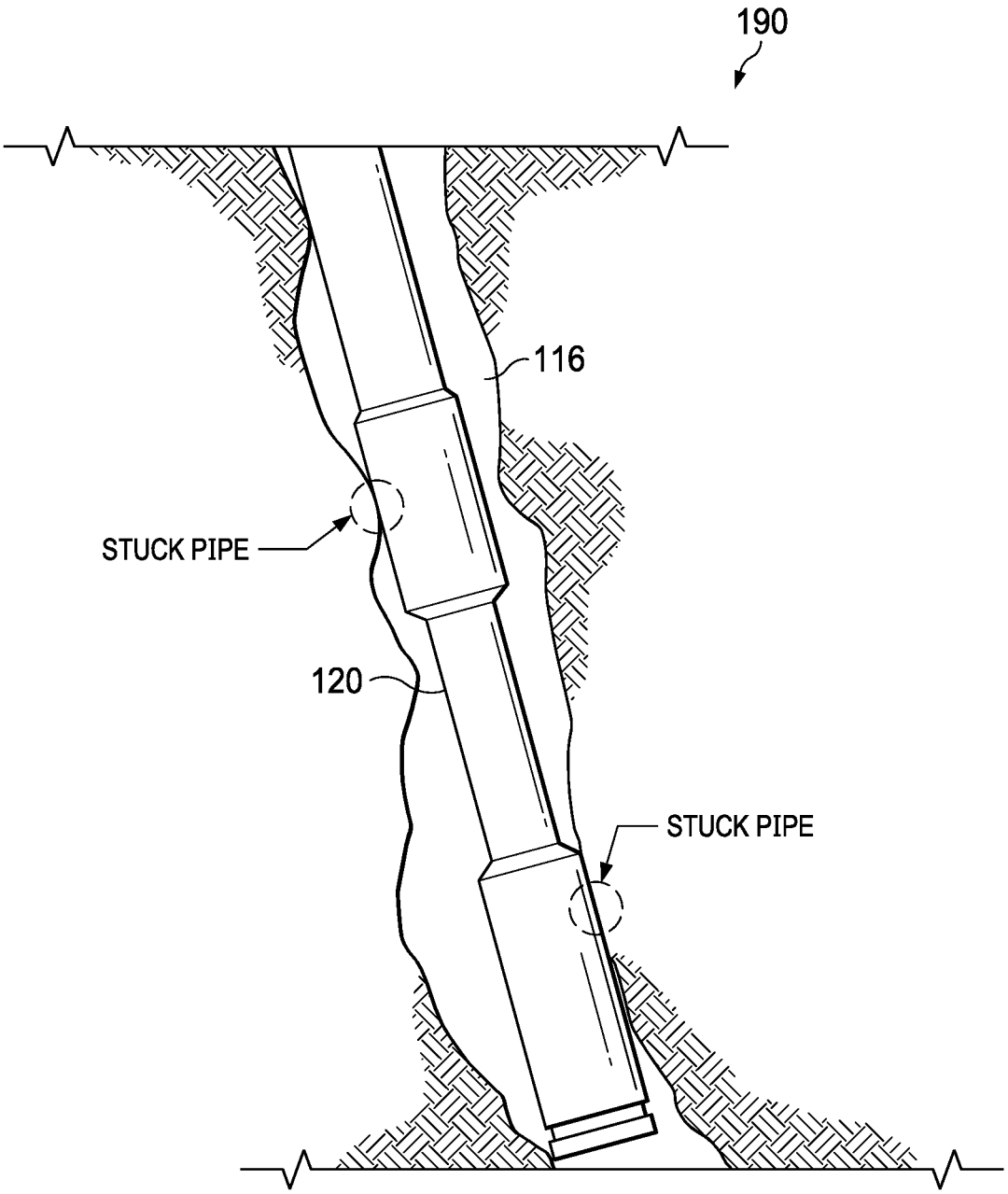
Figure 4A:
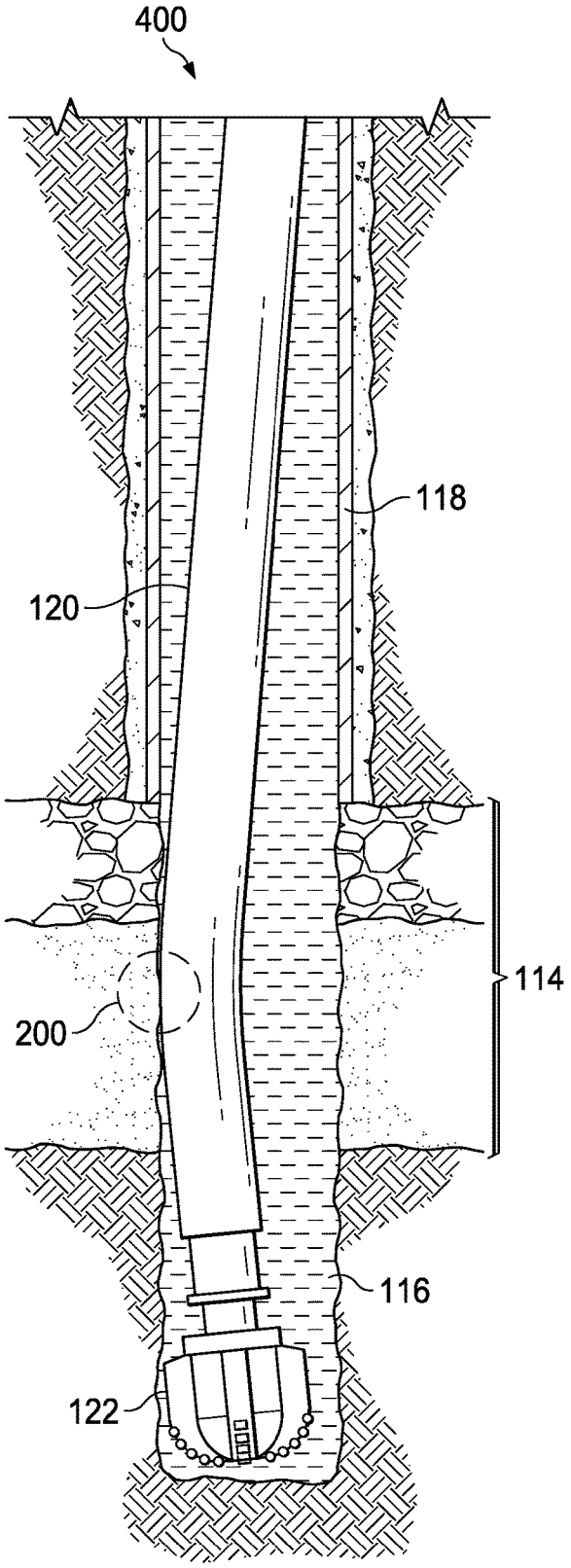
FIGS. 4A-4C are schematic views of a downhole autonomous cutting tool in various stages of operation.
Figure 4B:
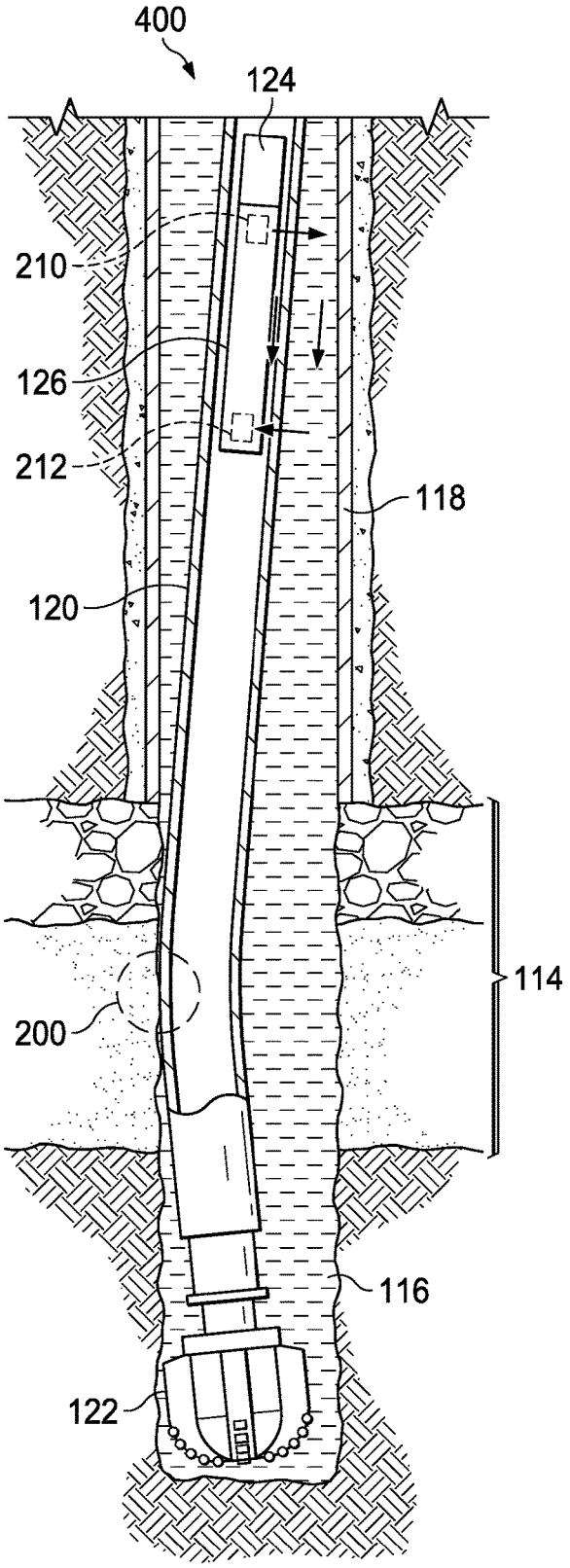
Figure 4C:
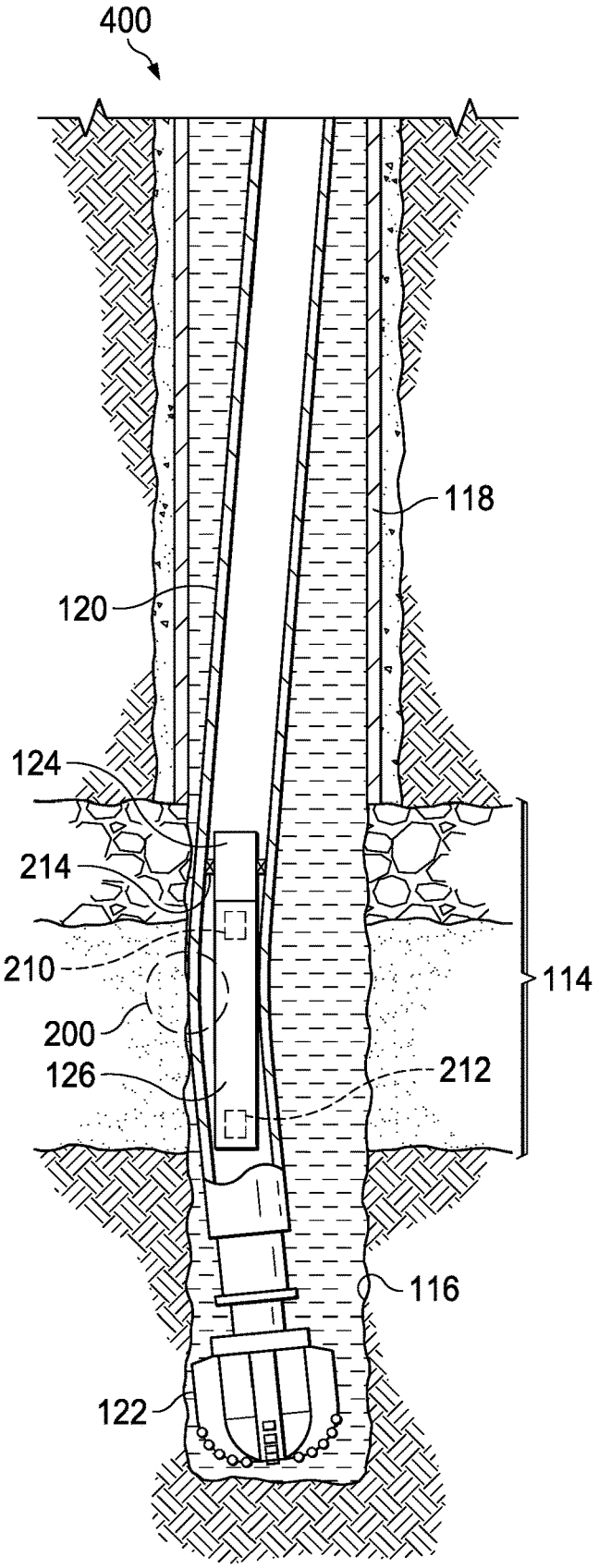

FIGS. 3A-3C are schematic views of different scenarios for a stuck pipe incident. FIG. 3A shows a drill string 106 a stuck due to accumulation of cuttings 168. FIG. 3B shows a drill string 106 stuck due to differential pressure 180 between the drill string 106 and the wellbore 108. FIG. 3C shows a drill string 106 due to the geometry of the wellbore 108. In these scenarios, the part of the drill pipe above the stuck point can be pulled up from the surface into a state of tension. The part of the drill pipe right below the stuck point is in a relaxed state. At the stuck point, a section of the drill string 106 makes contact with, and is held against, a wall of the wellbore. If a stuck pipe cannot be freed by other methods, the last option is to sever the pipe and perform a sidetrack to keep drilling the well. Prior to performing the sidetrack operation, the exact location and depth where the drill pipe is stuck is determined. The drill pipe is then severed at this point and a fishing operation is performed to recover the part of the drill string above the stuck point. The goal is to remove the string pipe at the greatest depth possible and, therefore, recover the most of the drill string FIGS. 4A-4C are schematic views of a downhole autonomous cutting tool 122 in various stages of operation. The drill string 106 is illustrated as making contact with the wall of the wellbore 108 and getting stuck at a location 200. When the stuck pipe situation is identified, operators try to free the drill string 106 by various methods. These include spotting acids, using jars, or applying cycles of high-force pick-ups and slack-offs. If unable to free the stuck pipe, the operators drop the downhole autonomous cutting into the drill string 106 (see FIG. 4B). The downhole autonomous cutting tool 122 travels with the drilling fluid 114 at a controlled speed down the drill string 106. The flow rate of the drilling fluid 114 controls the travel speed of the downhole autonomous cutting tool 122. Although able to travel all the way to the bottom hole assembly (BHA), the cutting tool 122 is activated and fixed in position when the tool identifies the stuck pipe location using the sensor module 126. The sensor module 126 senses properties of the drill string 106 and the sensor module 126 or the control unit identify the stuck point location 200 by the transition between a portion of the drill string 106 in tension and a portion of the drill string 106 in a relaxed state, i.e., only subject to its own weight. Once the stuck point 200 is located, the control unit 138 receives an output from the sensor module 126 and sends a signal to open a main valve to allow drilling fluid to flow through the cutting tool 122. The control unit 138 actuates the locking unit 136 to engage inner surfaces of the drill string 106 and anchor the tool 122 in place. The control unit 138 also sends a signal to the actuation unit 148 to engage and extend the plurality of cutting elements 158 from their running position to their cutting position in order to severe the stuck string 106. The sensor module 126 includes sensors, instrumentation and signal processing circuits, transmitters 210, receivers 212, connecting probes, and data storing and processing devices. The sensor module 126 may generate, for example, magnetic fields or acoustic waves and use fundamental physics phenomena to determine the stuck point location 200 of the drill string 106.

Figure 5:
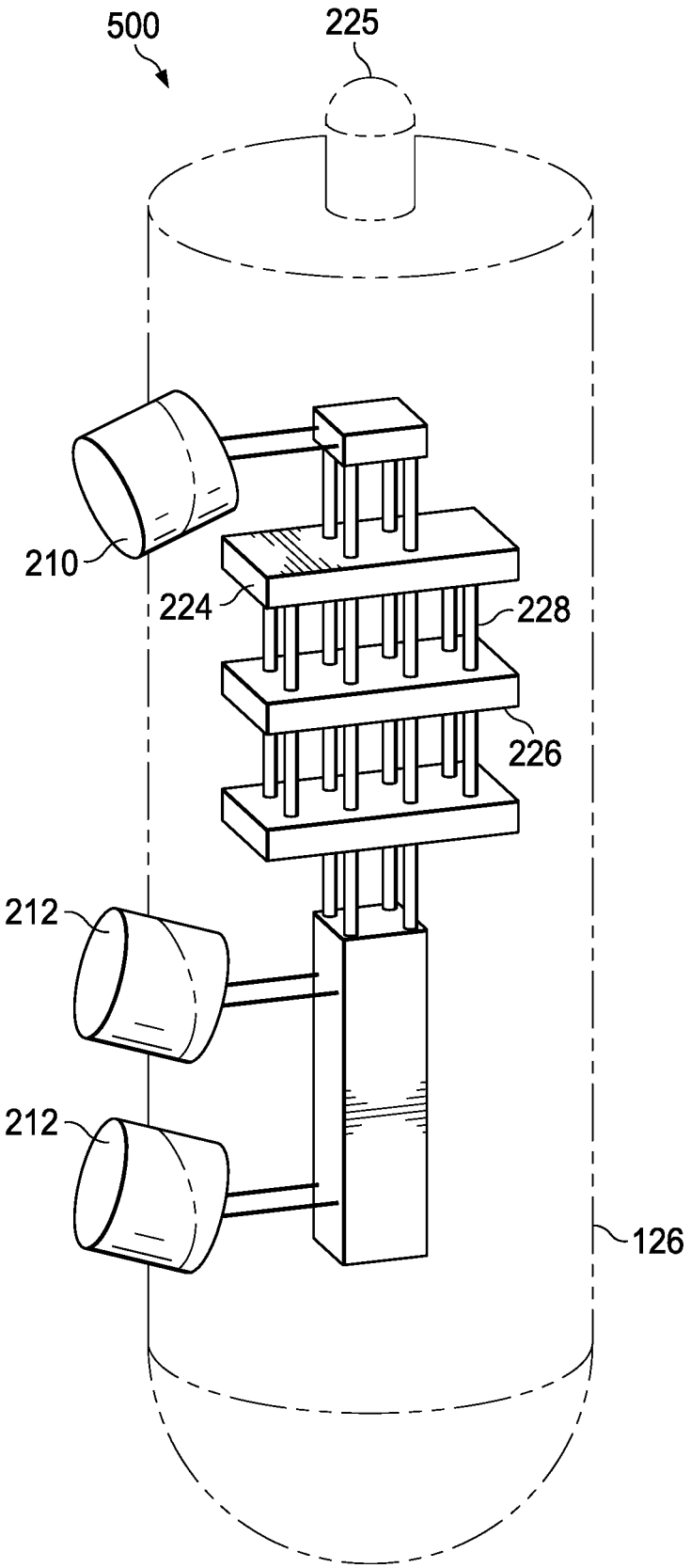
FIG. 5 is a schematic view of a downhole autonomous cutting tool with a sensor module configuration incorporating an acoustic sensor.

FIG. 5 is a schematic view of a downhole autonomous cutting tool 122 with a sensor module 500 incorporating an acoustic sensor. The sensor module 500 includes an acoustic transmitter 210, an acoustic receiver 212, a sensor circuitry 224, a microcontroller 226, a connector probe 225 (e.g., connector probes commercially available from Flow Control, Victrex, or Hermetic Solutions), and a plurality of through-chip vias 228. In some examples, the sensor module includes a micro-electromechanical system (MEMS) sensors and communication modules. The sensor module can include a three dimensional large-scale integration (3D-LSI) technology. This type of 3D integration can reduce the overall size of the sensor module and the cost of the overall tool. The smaller size technology enables a packing of a large number of sub modules such as sensors, microcontrollers, and communications in a compartment. The stacked-type sub-modules 224, 226 can be interconnected with short signal paths known as through-chip vias 228 or through-silicon vias (TSVs). This configuration can also be aligned to eliminate vibration. The sensor module can include a protective cover to protect the sub modules from the harsh downhole environment. The protective cover can include chemical coatings (e.g., polymers, epoxy, resin-based materials) or material that can withstand continuous exposure to the harsh downhole environment.

The acoustic transmitter 210 is oriented to send an acoustic signal radially outward relative to an axis of the tool 122. For example, the acoustic transmitter 210 of some sensor modules emits an acoustic signal at a frequency between 20 and 30 kilohertz (kHz). The acoustic signal travels through a section of the drill string 106 and/or the casing 112 and the drilling fluid 114 inside and outside the drill string 106 (see FIG. 4B). The acoustic wave can travel in an extensional or flexural mode, and the amplitude of the acoustic signal is measured at the acoustic receiver 212. The acoustic signal is then converted into attenuation by obtaining the ratio of amplitude between the transmitter 210 and the receiver 212. This change in attenuation of the acoustic signal allows the control unit 138 to identify the depth of the stuck location 200 where interaction between the string 106 and the walls of the wellbore 108 limits downhole movement of the string 106. In some examples, the sensor module 126 can include a plurality of receivers 212 spaced apart from the transmitter 210, and multiple transmitters 210 and receivers 212 around the sensor module 126. In some examples, the spacing between the transmitter and the receiver is between three and ten feet. Higher attenuation and lower signal amplitude can be an indication of a stuck pipe location where the drill pipe is in direct contact with the wellbore wall. At portions of the drill string 106 other than the stuck pipe location, the attenuation is typically lower and the signal amplitude is higher because the drill pipe is inside the wellbore but contacts the drilling fluid only. The acoustic sensor can include piezoelectric materials (e.g., quartz, langasite, lithium niobate, titanium oxide, lead zirconate titanate, other materials exhibiting piezoelectricity, or combination thereof).

Figure 6A:
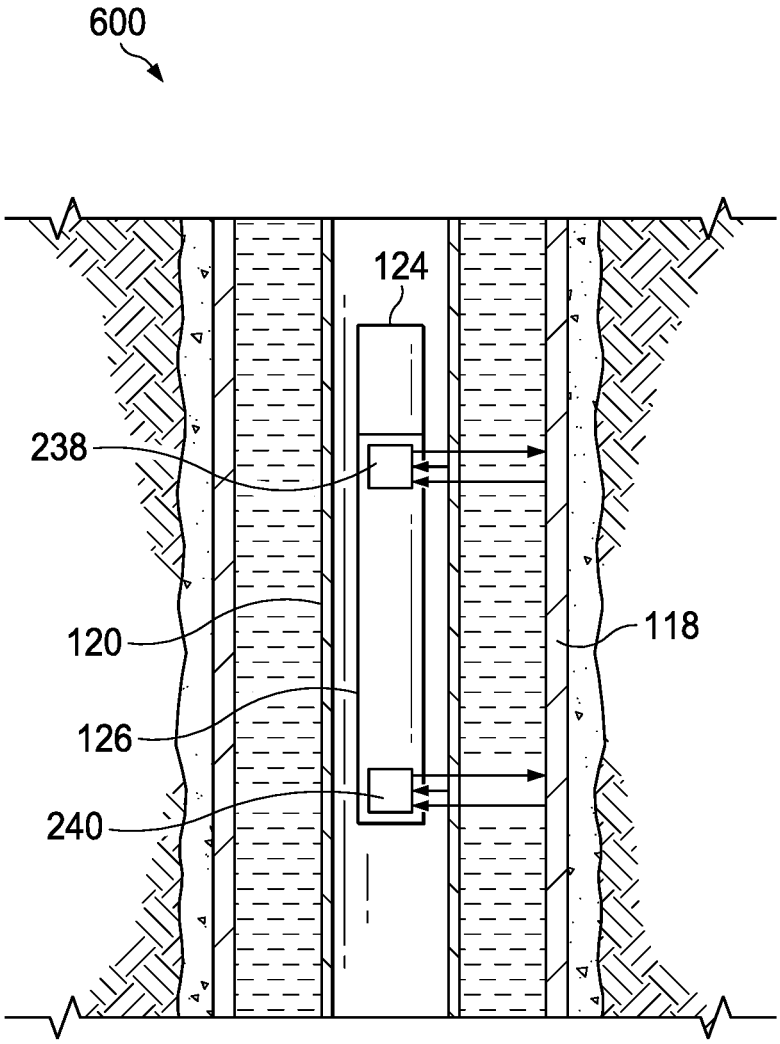
FIGS. 6A-6B are schematic views of a downhole autonomous cutting tool with a sensor module configuration incorporating an ultrasonic sensor.
Figure 6B:
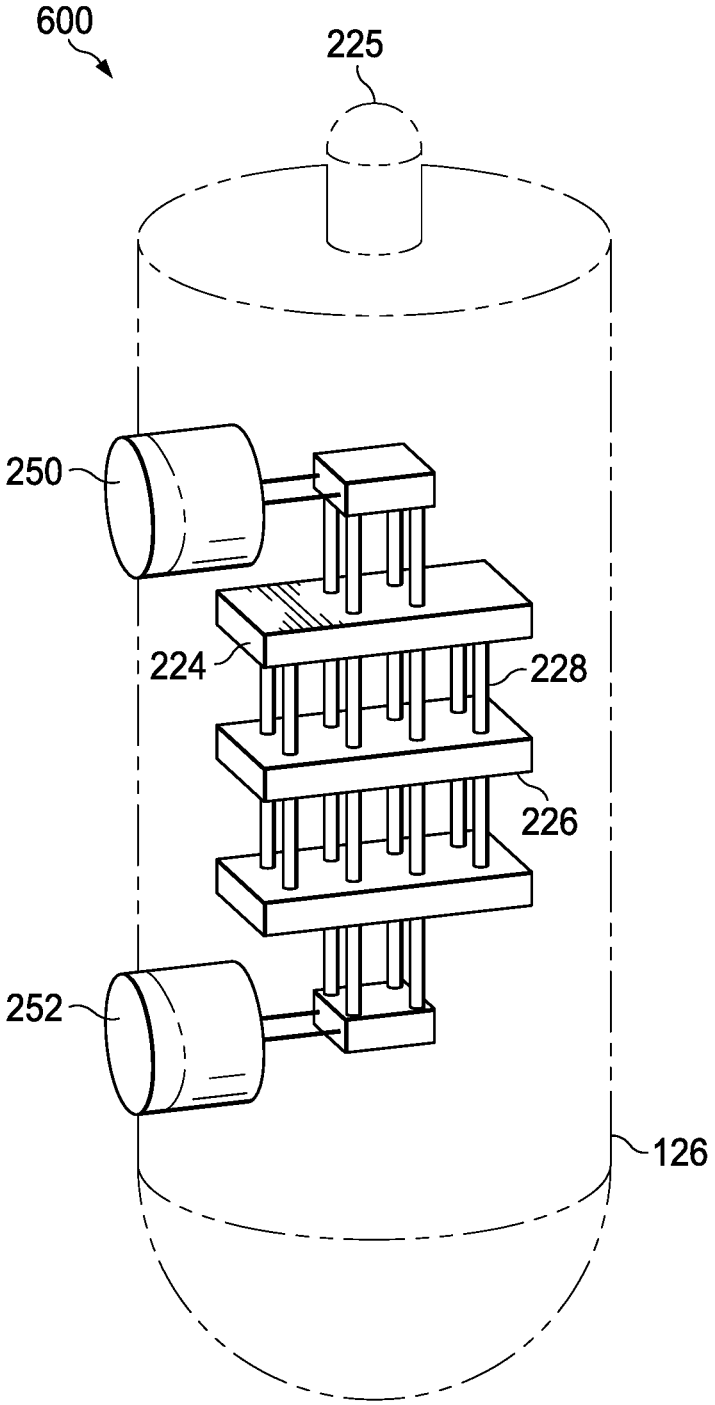

FIGS. 6A-6B are schematic views of a downhole autonomous cutting tool 122 with a sensor module 600 incorporating an ultrasonic sensor. The sensor module 600 is substantially similar to the sensor module 500 but incorporates top and bottom ultrasonic sensors 250, 252 in place of the acoustic sensors. The sensor module 600 includes rotating transducers 250, 252 with a motor enabling them to rotate around the sensor module 126 as the downhole autonomous cutting tool 122 is traveling downhole. The microelectronics 224, 226, and 228 perform signal processing and analysis to determine the stuck point 200 by comparing the sensor outputs from the top sensor 250 and the bottom sensor 252. This sensor module 600 uses an ultrasonic pulse echo technique. The transceiver 238 transmits an acoustic pulse at a frequency and listens for the "echo" from this pulse. In some examples, the frequency is between 200 and 700 kHz. The pulse propagates back and forth and creates additional pulses at the receiver 240 (e.g., an "echo" train). The sound propagation time is determined by the sound velocity and by the associated elastic constant. The time evolution of the amplitude of the received pulse is defined by the sound attenuation. In an example, a pulse would reflect back from the interface between the drill string 106 and the drilling fluid 114 or at the interface between the casing 112 and the wall of the wellbore 108. Some of the energy is reflected and some is refracted. At a stuck pipe location, the attenuation will be lower and the amplitude of the echo pulse higher. The transceivers can be spaced apart and able to communicate with one another. The spacing is between three and ten feet. As the autonomous cutting tool 122 travels downhole, the transceivers are constantly acquiring and comparing data. As a result of the spacing, one transceiver reaches the stuck point 200 before the other. This acoustic change between the transceivers is used to determine the depth of the stuck point 200. In an example, if one transceiver is not exactly at the stuck point location the change in acoustic contrast will still be apparent.

Figure 7A:
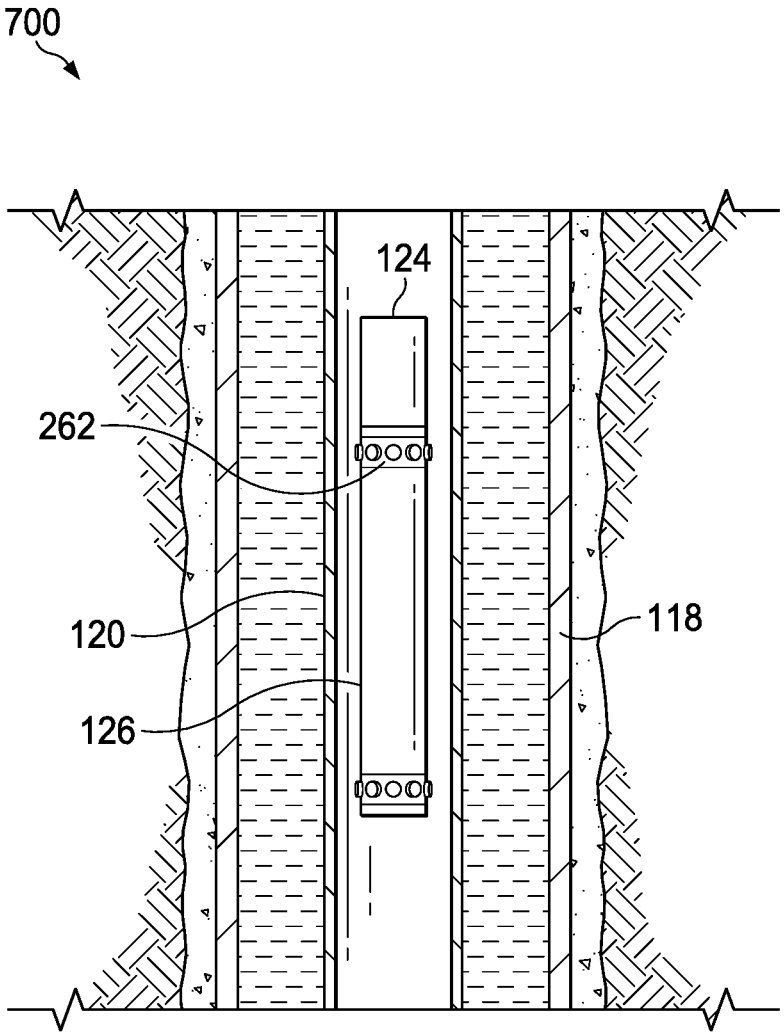
FIGS. 7A-7B are schematic views of a downhole autonomous cutting tool with a sensor module configuration incorporating a transceiver array.
Figure 7B:
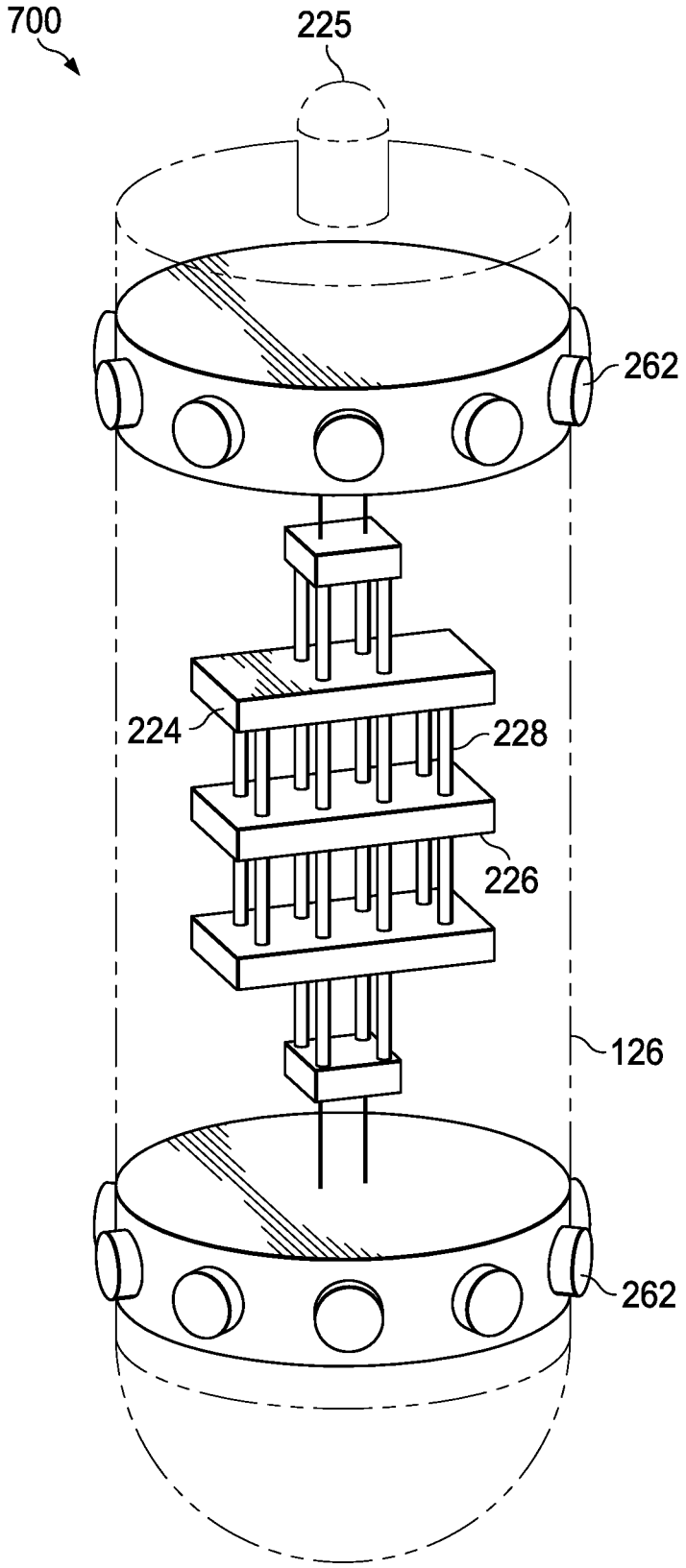

FIGS. 7A-7B are schematic views of a downhole autonomous cutting tool 122 with a sensor module 700 incorporating a transceiver array 262. The sensor module 700 is substantially similar to the sensor module 500 but incorporates transmitters and receivers configured as transceiver arrays 262. This configuration enables full coverage of the drill string 106. A similar methodology of having two transducers spaced apart can be utilized to determine the stuck point depth (as shown in FIG. 5).

Figure 8B:
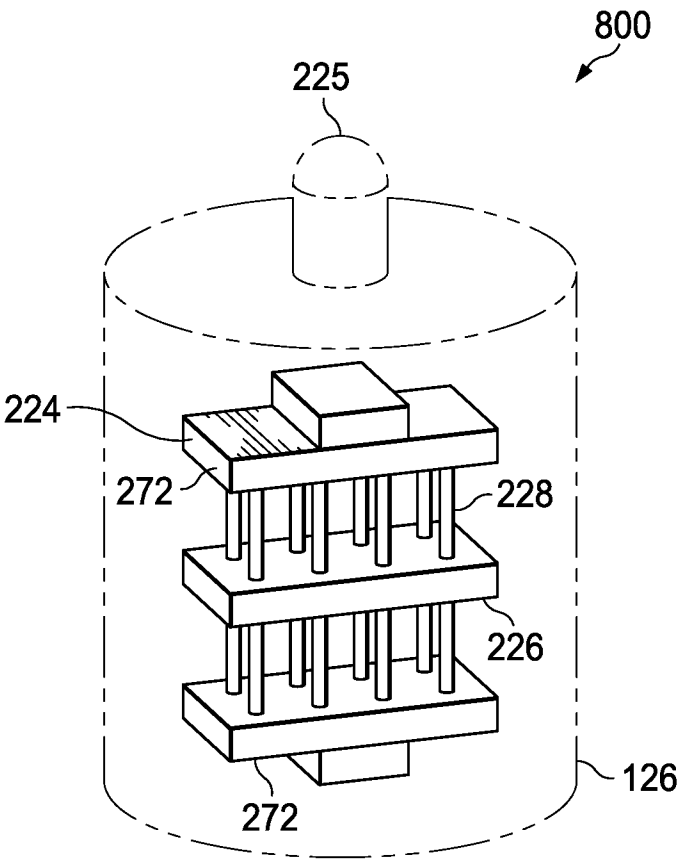
FIGS. 8A-8B are schematic views of a downhole autonomous cutting tool with a sensor module configuration incorporating electromagnetic wave-based sensors.
Figure 8A:
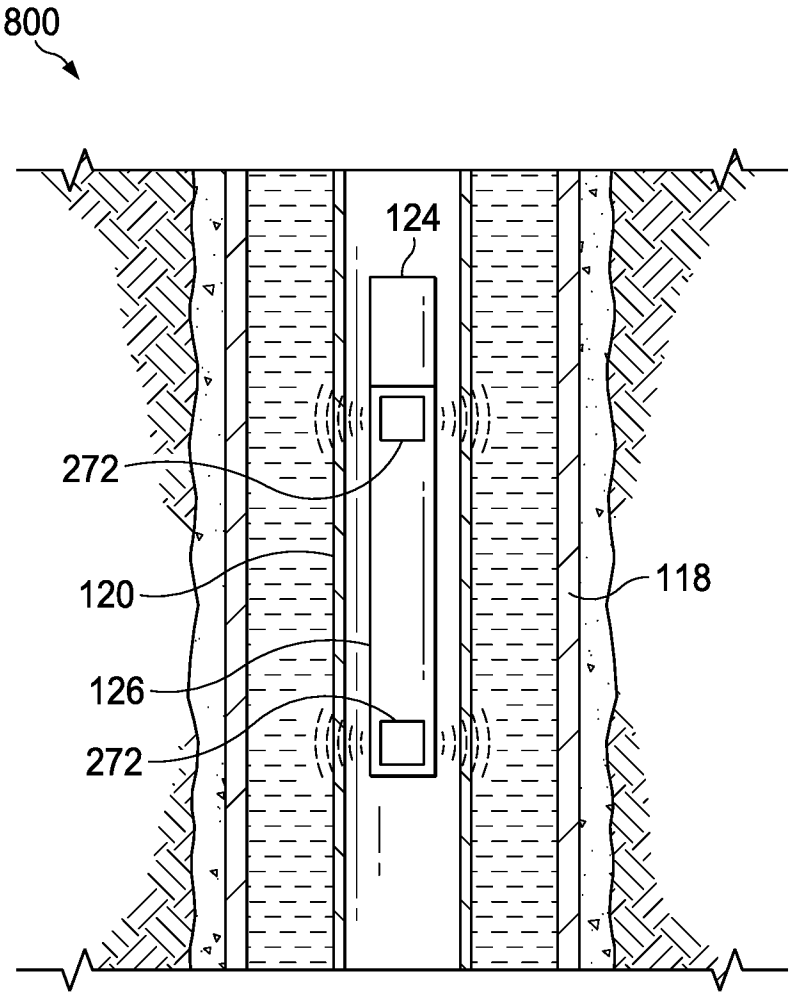

FIGS. 8A-8B are schematic views of a downhole autonomous cutting tool 122 with a sensor module 800 incorporating electromagnetic wave-based sensors 272. The sensor module 800 is substantially similar to the sensor module 500 but incorporates transmitters and receivers configured as electromagnetic wave-based sensors 272. The sensor module 800 has two electromagnets 272 spaced apart and able to communicate with each other downhole. As the downhole autonomous cutting tool 122 travels downhole, the electromagnets generate a magnetic field and an increased tension or torque is applied to the drill string 106. In an example, a steel drill pipe is demagnetized due to the deformation caused by tension or torque applied to the drill string 106. The section of the drill string 106 above the stuck point 200 is also demagnetized but the section below the stuck point 200 retains its ferromagnetic properties. In this case, the two electromagnets record a low or no magnetic flux density at the section of the drill pipe above the stuck point 200. In an example, when one of the electromagnets reaches the stuck point 200, or is below the stuck point 200, a clear magnetic contrast is obtained between the magnetic flux density values above and below the stuck point 200. The magnetic sensors 272 detect magnetic fields from electromagnets. The magnetic sensors can be thin film sensors (e.g., giant magnetoresistance sensors (GMRs), tunneling magnetoresistance sensors (TMRs), and Hall sensors). In some tools, the MEMS technology, the magnetic sensor, and the electromagnet can be integrated into a single device. In another example, a magnetic sensor can be fabricated as a MEMS device that operates with less power than larger sensors such as fluxgate magnetometers. In some examples, both the magnetic and the acoustic type sensors maybe integrated into one sensor module.

Figure 9:
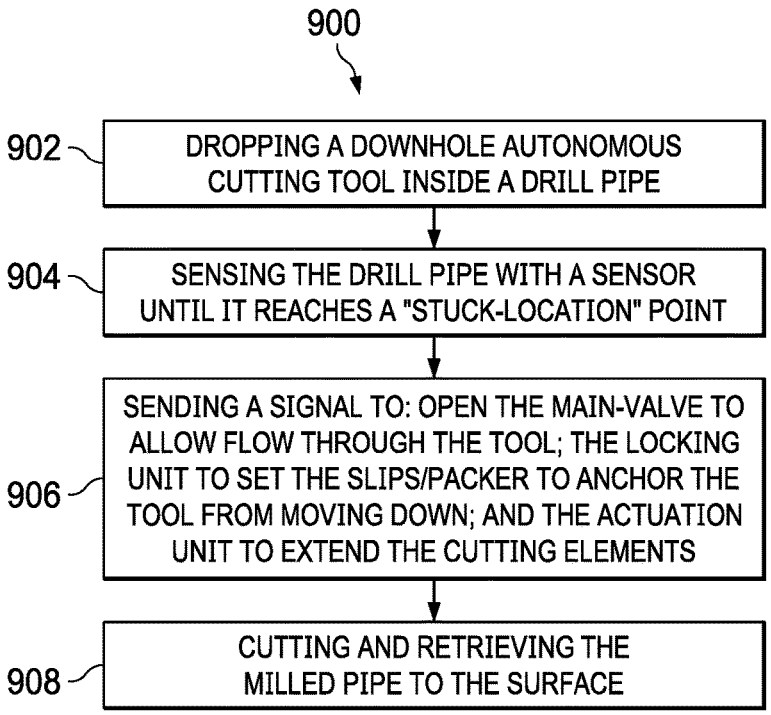
FIG. 9 is a flowchart showing a method for cutting a pipe in a wellbore.

FIG. 9 is a flowchart of a method 900 for cutting a pipe in a wellbore. During drilling operations, a pipe is stuck within the wellbore. A downhole autonomous cutting tool is dropped inside a drill pipe (902). The downhole autonomous cutting tool senses properties of the drill pipe until the sensor module detects the change in sensor output or the change in attenuation acoustic wave (904). This change is correlated to detecting and identifying the stuck pipe location and the depth of the "stuck" location. The real-time data from the sensor module is transmitted to the control unit within the downhole autonomous cutting tool. The control unit processes the received data using the data processing system and sends a signal to open the main valve to allow flow through the tool and to a locking unit to anchor the tool in position by setting the slips or the packer element (906). Once the downhole autonomous cutting tool is anchored in place, the control unit sends a signal to the actuation unit to extend the cutting elements and to start cutting/milling the stuck pipe. Once the milling is completed, the milled pipe is fished and retrieved to the surface (908).

Figure 10:
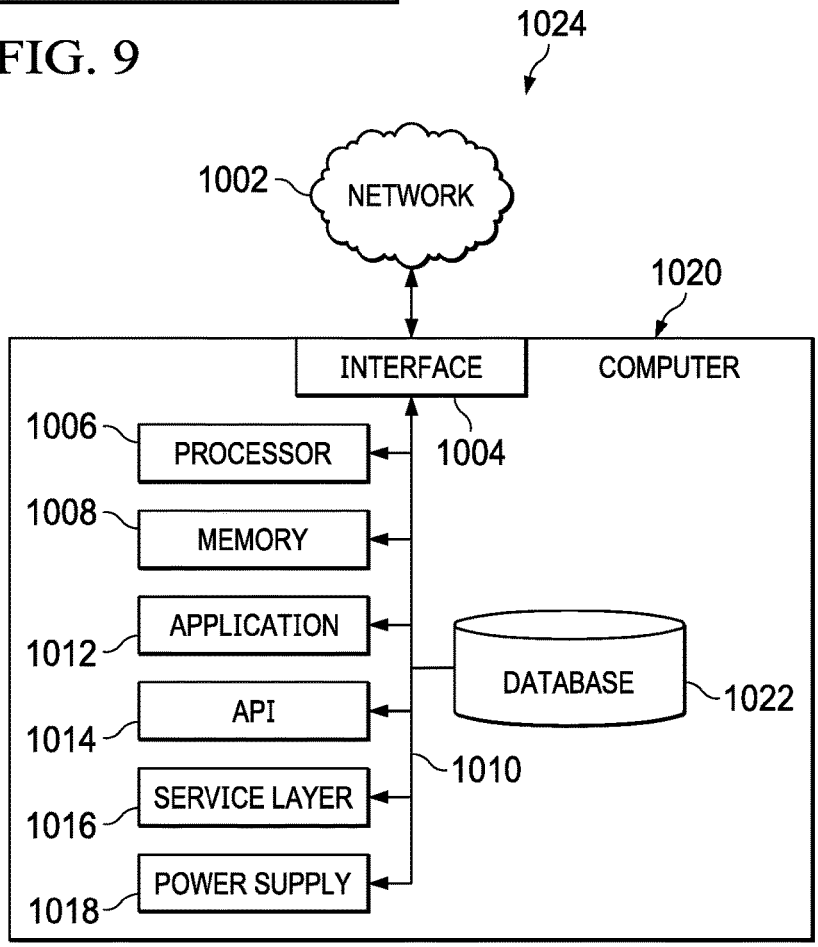
FIG. 10 is a block diagram of an example computer system.

FIG. 10 is a block diagram of an example computer system 1024 used to provide computational functionalities associated with described algorithms, methods, functions, processes, flows, and procedures described in the present disclosure, according to some implementations of the present disclosure. The illustrated computer 1020 is intended to encompass any computing device such as a server, a desktop computer, a laptop/notebook computer, a wireless data port, a smartphone, a personal data assistant (PDA), a tablet computing device, or one or more processors within these devices, including physical instances, virtual instances, or both. The computer 1020 can include input devices such as keypads, keyboards, and touch screens that can accept user information. Also, the computer 1020 can include output devices that can convey information associated with the operation of the computer 1020 The information can include digital data, visual data, audio information, or a combination of information. The information can be presented in a graphical user interface (UI) (or GUI).

The computer 1020 can serve in a role as a client, a network component, a server, a database, a persistency, or components of a computer system for performing the subject matter described in the present disclosure. The illustrated computer 1020 is communicably coupled with a network 1002. In some implementations, one or more components of the computer 1020 can be configured to operate within different environments, including cloud-computing-based environments, local environments, global environments, and combinations of environments.

At a high level, the computer 1020 is an electronic computing device operable to receive, transmit, process, store, and manage data and information associated with the described subject matter. According to some implementations, the computer 1020 can also include, or be communicably coupled with, an application server, an email server, a web server, a caching server, a streaming data server, or a combination of servers.

The computer 1020 can receive requests over network 1002 from a client application (for example, executing on another computer 1020). The computer 1020 can respond to the received requests by processing the received requests using software applications. Requests can also be sent to the computer 1020 from internal users (for example, from a command console), external (or third) parties, automated applications, entities, individuals, systems, and computers. Each of the components of the computer 1020 can communicate using a system bus 1010. In some implementations, any or all of the components of the computer 1020, including hardware or software components, can interface with each other or the interface 1004 (or a combination of both), over the system bus 1010. Interfaces can use an application programming interface (API) 1014, a service layer 1016, or a combination of the API 1014 and service layer 1016. The API 1014 can include specifications for routines, data structures, and object classes. The API 1014 can be either computer-language independent or dependent. The API 1014 can refer to a complete interface, a single function, or a set of APIs.

The service layer 1016 can provide software services to the computer 1020 and other components (whether illustrated or not) that are communicably coupled to the computer 1020. The functionality of the computer 1020 can be accessible for all service consumers using this service layer. Software services, such as those provided by the service layer 1016, can provide reusable, defined functionalities through a defined interface. For example, the interface can be software written in JAVA, C++, or a language providing data in extensible markup language (XML) format. While illustrated as an integrated component of the computer 1020, in alternative implementations, the API 1014 or the service layer 1016 can be stand-alone components in relation to other components of the computer 1020 and other components communicably coupled to the computer 1020. Moreover, any or all parts of the API 1014 or the service layer 1016 can be implemented as child or sub-modules of another software module, enterprise application, or hardware module without departing from the scope of the present disclosure.

The computer 1020 includes an interface 1004. Although illustrated as a single interface 1004 in FIG. 10, two or more interfaces 1004 can be used according to particular needs, desires, or particular implementations of the computer 1020 and the described functionality. The interface 1004 can be used by the computer 1020 for communicating with other systems that are connected to the network 1002 (whether illustrated or not) in a distributed environment. Generally, the interface 1004 can include, or be implemented using, logic encoded in software or hardware (or a combination of software and hardware) operable to communicate with the network 1002. More specifically, the interface 1004 can include software supporting one or more communication protocols associated with communications. As such, the network 1002 or the interface's hardware can be operable to communicate physical signals within and outside of the illustrated computer 1020.

The computer 1020 includes a processor 1006. Although illustrated as a single processor 1006 in FIG. 10, two or more processors 1006 can be used according to particular needs, desires, or particular implementations of the computer 1020 and the described functionality. Generally, the processor 1006 can execute instructions and can manipulate data to perform the operations of the computer 1020, including operations using algorithms, methods, functions, processes, flows, and procedures as described in the present disclosure.

The computer 1020 also includes a database 1022 that can hold data for the computer 1020 and other components connected to the network 1002 (whether illustrated or not). For example, database 1022 can be an in-memory, conventional, or a database storing data consistent with the present disclosure. In some implementations, database 1022 can be a combination of two or more different database types (for example, hybrid in-memory and conventional databases) according to particular needs, desires, or particular implementations of the computer 1020 and the described functionality. Although illustrated as a single database 1022 in FIG. 10, two or more databases (of the same, different, or combination of types) can be used according to particular needs, desires, or particular implementations of the computer 1020 and the described functionality. While database 1022 is illustrated as an internal component of the computer 1020, in alternative implementations, database 1022 can be external to the computer 1020.

The computer 1020 also includes a memory 1008 that can hold data for the computer 1020 or a combination of components connected to the network 1002 (whether illustrated or not). Memory 1008 can store any data consistent with the present disclosure. In some implementations, memory 1008 can be a combination of two or more different types of memory (for example, a combination of semiconductor and magnetic storage) according to particular needs, desires, or particular implementations of the computer 1020 and the described functionality. Although illustrated as a single memory 1008 in FIG. 10, two or more memories 1008 (of the same, different, or combination of types) can be used according to particular needs, desires, or particular implementations of the computer 1020 and the described functionality. While memory 1008 is illustrated as an internal component of the computer 1020, in alternative implementations, memory 1008 can be external to the computer 1020.

The application 1012 can be an algorithmic software engine providing functionality according to particular needs, desires, or particular implementations of the computer 1020 and the described functionality. For example, application 1012 can serve as one or more components, modules, or applications. Further, although illustrated as a single application 1012, the application 1012 can be implemented as multiple applications 1012 on the computer 1020. In addition, although illustrated as internal to the computer 1020, in alternative implementations, the application 1012 can be external to the computer 1020.

The computer 1020 can also include a power supply 1018. The power supply 1018 can include a rechargeable or non-rechargeable battery that can be configured to be either user- or non-user-replaceable. In some implementations, the power supply 1018 can include power-conversion and management circuits, including recharging, standby, and power management functionalities. In some implementations, the power-supply 1018 can include a power plug to allow the computer 1020 to be plugged into a wall socket or a power source to, for example, power the computer 1020 or recharge a rechargeable battery.

There can be any number of computers 1020 associated with, or external to, a computer system containing computer 1020, with each computer 1020 communicating over network 1002. Further, the terms "client," "user," and other appropriate terminology can be used interchangeably, as appropriate, without departing from the scope of the present disclosure. Moreover, the present disclosure contemplates that many users can use one computer 1020 and one user can use multiple computers 1020.

Implementations of the subject matter and the functional operations described in this specification can be implemented in digital electronic circuitry, intangibly embodied computer software or firmware, in computer hardware, including the structures disclosed in this specification and their structural equivalents, or in combinations of one or more of them. Software implementations of the described subject matter can be implemented as one or more computer programs. Each computer program can include one or more modules of computer program instructions encoded on a tangible, non-transitory, computer-readable computer-storage medium for execution by, or to control the operation of, data processing apparatus. Alternatively, or additionally, the program instructions can be encoded in/on an artificially-generated propagated signal. The example, the signal can be a machine-generated electrical, optical, or electromagnetic signal that is generated to encode information for transmission to suitable receiver apparatus for execution by a data processing apparatus. The computer-storage medium can be a machine-readable storage device, a machine-readable storage substrate, a random or serial access memory device, or a combination of computer-storage mediums.

The terms "data processing apparatus," "computer," and "electronic computer device" (or equivalent as understood by one of ordinary skill in the art) refer to data processing hardware. For example, a data processing apparatus can encompass all kinds of apparatus, devices, and machines for processing data, including by way of example, a programmable processor, a computer, or multiple processors or computers. The apparatus can also include special purpose logic circuitry including, for example, a central processing unit (CPU), a field programmable gate array (FPGA), or an application specific integrated circuit (ASIC). In some implementations, the data processing apparatus or special purpose logic circuitry (or a combination of the data processing apparatus or special purpose logic circuitry) can be hardware- or software-based (or a combination of both hardware- and software-based). The apparatus can optionally include code that creates an execution environment for computer programs, for example, code that constitutes processor firmware, a protocol stack, a database management system, an operating system, or a combination of execution environments. The present disclosure contemplates the use of data processing apparatuses with or without conventional operating systems, for example LINUX, UNIX, WINDOWS, MAC OS, ANDROID, or IOS.

A computer program, which can also be referred to or described as a program, software, a software application, a module, a software module, a script, or code, can be written in any form of programming language. Programming languages can include, for example, compiled languages, interpreted languages, declarative languages, or procedural languages. Programs can be deployed in any form, including as stand-alone programs, modules, components, subroutines, or units for use in a computing environment. A computer program can, but need not, correspond to a file in a file system. A program can be stored in a portion of a file that holds other programs or data, for example, one or more scripts stored in a markup language document, in a single file dedicated to the program in question, or in multiple coordinated files storing one or more modules, sub programs, or portions of code. A computer program can be deployed for execution on one computer or on multiple computers that are located, for example, at one site or distributed across multiple sites that are interconnected by a communication network. While portions of the programs illustrated in the various figures may be shown as individual modules that implement the various features and functionality through various objects, methods, or processes, the programs can instead include a number of sub-modules, third-party services, components, and libraries. Conversely, the features and functionality of various components can be combined into single components as appropriate. Thresholds used to make computational determinations can be statically, dynamically, or both statically and dynamically determined.

The methods, processes, or logic flows described in this specification can be performed by one or more programmable computers executing one or more computer programs to perform functions by operating on input data and generating output. The methods, processes, or logic flows can also be performed by, and apparatus can also be implemented as, special purpose logic circuitry, for example, a CPU, an FPGA, or an ASIC.

Computers suitable for the execution of a computer program can be based on one or more of general and special purpose microprocessors and other kinds of CPUs. The elements of a computer are a CPU for performing or executing instructions and one or more memory devices for storing instructions and data. Generally, a CPU can receive instructions and data from (and write data to) a memory. A computer can also include, or be operatively coupled to, one or more mass storage devices for storing data. In some implementations, a computer can receive data from, and transfer data to, the mass storage devices including, for example, magnetic, magneto optical disks, or optical disks. Moreover, a computer can be embedded in another device, for example, a mobile telephone, a personal digital assistant (PDA), a mobile audio or video player, a game console, a global positioning system (GPS) receiver, or a portable storage device such as a universal serial bus (USB) flash drive.

Computer readable media (transitory or non-transitory, as appropriate) suitable for storing computer program instructions and data can include all forms of permanent/non-permanent and volatile/non-volatile memory, media, and memory devices. Computer readable media can include, for example, semiconductor memory devices such as random access memory (RAM), read only memory (ROM), phase change memory (PRAM), static random access memory (SRAM), dynamic random access memory (DRAM), erasable programmable read-only memory (EPROM), electrically erasable programmable read-only memory (EEPROM), and flash memory devices. Computer readable media can also include, for example, magnetic devices such as tape, cartridges, cassettes, and internal/removable disks. Computer readable media can also include magneto optical disks and optical memory devices and technologies including, for example, digital video disc (DVD), CD ROM, DVD+/−R, DVD-RAM, DVD-ROM, HD-DVD, and BLU-RAY. The memory can store various objects or data, including caches, classes, frameworks, applications, modules, backup data, jobs, web pages, web page templates, data structures, database tables, repositories, and dynamic information. Types of objects and data stored in memory can include parameters, variables, algorithms, instructions, rules, constraints, and references. Additionally, the memory can include logs, policies, security or access data, and reporting files. The processor and the memory can be supplemented by, or incorporated in, special purpose logic circuitry.

Implementations of the subject matter described in the present disclosure can be implemented on a computer having a display device for providing interaction with a user, including displaying information to (and receiving input from) the user. Types of display devices can include, for example, a cathode ray tube (CRT), a liquid crystal display (LCD), a light-emitting diode (LED), and a plasma monitor. Display devices can include a keyboard and pointing devices including, for example, a mouse, a trackball, or a trackpad. User input can also be provided to the computer through the use of a touchscreen, such as a tablet computer surface with pressure sensitivity or a multi-touch screen using capacitive or electric sensing. Other kinds of devices can be used to provide for interaction with a user, including to receive user feedback, for example, sensory feedback including visual feedback, auditory feedback, or tactile feedback. Input from the user can be received in the form of acoustic, speech, or tactile input. In addition, a computer can interact with a user by sending documents to, and receiving documents from, a device that is used by the user. For example, the computer can send web pages to a web browser on a user's client device in response to requests received from the web browser.

The term "graphical user interface," or "GUI," can be used in the singular or the plural to describe one or more graphical user interfaces and each of the displays of a particular graphical user interface. Therefore, a GUI can represent any graphical user interface, including, but not limited to, a web browser, a touch screen, or a command line interface (CLI) that processes information and efficiently presents the information results to the user. In general, a GUI can include a plurality of user interface (UI) elements, some or all associated with a web browser, such as interactive fields, pull-down lists, and buttons. These and other UI elements can be related to or represent the functions of the web browser.

Implementations of the subject matter described in this specification can be implemented in a computing system that includes a back end component, for example, as a data server, or that includes a middleware component, for example, an application server. Moreover, the computing system can include a front-end component, for example, a client computer having one or both of a graphical user interface or a Web browser through which a user can interact with the computer. The components of the system can be interconnected by any form or medium of wireline or wireless digital data communication (or a combination of data communication) in a communication network. Examples of communication networks include a local area network (LAN), a radio access network (RAN), a metropolitan area network (MAN), a wide area network (WAN), Worldwide Interoperability for Microwave Access (WIMAX), a wireless local area network (WLAN) (for example, using 802.11 a/b/g/n or 802.20 or a combination of protocols), all or a portion of the Internet, or any other communication system or systems at one or more locations (or a combination of communication networks). The network can communicate with, for example, Internet Protocol (IP) packets, frame relay frames, asynchronous transfer mode (ATM) cells, voice, video, data, or a combination of communication types between network addresses.

The computing system can include clients and servers. A client and server can generally be remote from each other and can typically interact through a communication network. The relationship of client and server can arise by virtue of computer programs running on the respective computers and having a client-server relationship.

Cluster file systems can be any file system type accessible from multiple servers for read and update. Locking or consistency tracking may not be necessary since the locking of exchange file system can be done at application layer. Furthermore, Unicode data files can be different from non-Unicode data files.

While this specification contains many specific implementation details, these should not be construed as limitations on the scope of what may be claimed, but rather as descriptions of features that may be specific to particular implementations. Certain features that are described in this specification in the context of separate implementations can also be implemented, in combination, in a single implementation. Conversely, various features that are described in the context of a single implementation can also be implemented in multiple implementations, separately, or in any suitable sub-combination. Moreover, although previously described features may be described as acting in certain combinations and even initially claimed as such, one or more features from a claimed combination can, in some cases, be excised from the combination, and the claimed combination may be directed to a sub-combination or variation of a sub-combination.

Particular implementations of the subject matter have been described. Other implementations, alterations, and permutations of the described implementations are within the scope of the following claims as will be apparent to those skilled in the art. While operations are depicted in the drawings or claims in a particular order, this should not be understood as requiring that such operations be performed in the particular order shown or in sequential order, or that all illustrated operations be performed (some operations may be considered optional), to achieve desirable results. In certain circumstances, multitasking or parallel processing (or a combination of multitasking and parallel processing) may be advantageous and performed as deemed appropriate.

Moreover, the separation or integration of various system modules and components in the previously described implementations should not be understood as requiring such separation or integration in all implementations, and it should be understood that the described program components and systems can generally be integrated together in a single software product or packaged into multiple software products.

Accordingly, the previously described example implementations do not define or constrain the present disclosure. Other changes, substitutions, and alterations are also possible without departing from the spirit and scope of the present disclosure.

Furthermore, any claimed implementation is considered to be applicable to at least a computer-implemented method; a non-transitory, computer-readable medium storing computer-readable instructions to perform the computer-implemented method; and a computer system comprising a computer memory interoperably coupled with a hardware processor configured to perform the computer-implemented method or the instructions stored on the non-transitory, computer-readable medium.

A number of embodiments of these systems and methods have been described. Nevertheless, it will be understood that various modifications may be made without departing from the spirit and scope of this disclosure. Accordingly, other embodiments are within the scope of the following claims.

What is claimed:

1. A downhole autonomous cutting tool configured to cut a pipe in a wellbore, the downhole autonomous cutting tool comprising:

a body comprising a hydraulic motor, the body having a generally cylindrical configuration such that the body limits a downhole flow of fluids past the downhole autonomous cutting tool between the downhole autonomous cutting tool and the pipe when the tool is deployed in the pipe, wherein the hydraulic motor comprises a rotor embedded inside a stator;

a locking unit attached to the body, the locking unit actuable to engage inner surfaces of the pipe in the wellbore;

a sensor module comprises an acoustic transmitter oriented to send an acoustic signal radially outward relative to an axis of the tool and operable to detect interactions between the pipe and walls of the wellbore;

an actuation unit attached to the body and rotatable by the hydraulic motor, the actuation unit operable to move a plurality of cutting elements between a running position and a cutting position, wherein the actuation unit is rotationally fixed to the rotor of the hydraulic motor; and a control unit in electronic communication with the sensor module, the locking unit, and the actuation unit, the control unit configured to:

identify a location where interaction between the pipe and the walls of the wellbore limits downhole movement of the pipe based on output of the sensor module;

actuate the locking unit to engage inner surfaces of the pipe in the wellbore; and operate the actuation unit to move the plurality of cutting elements from the running position to the cutting position.

2. The downhole autonomous cutting tool of claim 1, wherein the locking unit comprises a packer.

3. The downhole autonomous cutting tool of claim 2, wherein the locking unit comprises slips.

4. The downhole autonomous cutting tool of claim 1, wherein the acoustic signal has a frequency of 20-30 kHz.

5. The downhole autonomous cutting tool of claim 1, wherein the sensor module further comprises an acoustic receiver and the control unit is configured to identify the location where interaction between the pipe and the walls of the wellbore limits downhole movement of the pipe based on output of the sensor module by a change in attenuation of the acoustic signal.

6. The downhole autonomous cutting tool of claim 1, wherein the sensor module comprises an electromagnetic transmitter oriented to generate magnetic field radially outward relative to the axis of the tool.

7. The downhole autonomous cutting tool of claim 6, wherein the sensor module further comprises an electromagnetic receiver and the control unit is configured to identify the location where interaction between the pipe and the walls of the wellbore limits downhole movement of the pipe based on a difference between sensor outputs.

8. The downhole autonomous cutting tool of claim 1, wherein the sensor module comprises an ultrasonic sensor.

9. The downhole autonomous cutting tool of claim 1, wherein the body further comprises rubber baffles extending radially outward.

10. The downhole autonomous cutting tool of claim 1, wherein the actuation unit comprises a plurality of linear actuators attached to the plurality of cutting elements, each linear actuator operable to move an associated cutting element radially relative to the axis of the tool.

11. The downhole autonomous cutting tool of claim 10, wherein each of the cutting elements comprises a milling knife.

12. A downhole autonomous cutting tool configured to cut a pipe in a wellbore, the downhole autonomous cutting tool comprising:

a body comprising a hydraulic motor with a rotor embedded inside a stator, wherein the body further comprises rubber baffles extending radially outward;

a locking unit attached to the body, the locking unit actuable to engage inner surfaces of the pipe in the wellbore;

a sensor module operable to detect interactions between the pipe and walls of the wellbore; and an actuation unit with a plurality of cutting elements moveable between a running position and a cutting position, the actuation unit rotationally fixed to the rotor.

13. The downhole autonomous cutting tool of claim 12, further comprising a control unit in electronic communication with the sensor module, the locking unit, and the actuation unit, the control unit configured to:

identify a location where interaction between the pipe and the walls of the wellbore limits a downhole movement of the pipe based on output of the sensor module;

actuate the locking unit to engage inner surfaces of the pipe in the wellbore; and operate the actuation unit to move the plurality of cutting elements from the running position to the cutting position.

14. The downhole autonomous cutting tool of claim 12, wherein the locking unit comprises a packer.

15. The downhole autonomous cutting tool of claim 14, wherein the locking unit comprises slips.

16. The downhole autonomous cutting tool of claim 12, wherein the sensor module comprises an acoustic transmitter oriented to send an acoustic signal radially outward relative to an axis of the tool.

17. The downhole autonomous cutting tool of claim 16, wherein the actuation unit comprises a plurality of linear actuators attached to the plurality of cutting elements, each linear actuator operable to move an associated cutting element radially relative to the axis of the tool.

18. A method for cutting a pipe in wellbores, the method comprising:

dropping a downhole autonomous cutting tool in a pipe, the downhole autonomous cutting tool controlled by a flow rate and configured to identify a location where interaction between the pipe and walls of the wellbore limits a downhole movement of the pipe, wherein dropping the downhole autonomous cutting tool in the pipe comprises flowing a drilling fluid through the wellbore past rubber baffles extending radially outward from a body of the downhole autonomous cutting tool to carry the downhole autonomous cutting tool through the wellbore;

sensing the pipe with a sensor module until it reaches the location where interaction between the pipe and the walls of the wellbore limits a downhole movement of the pipe;

receiving a signal from the sensor module with an identified location;

sending a signal to open a main valve to allow flow through the downhole autonomous cutting tool;

locking the downhole autonomous cutting tool in position relative to the pipe and preventing the tool from moving further downhole;

sending a signal to an actuation unit to engage and extend a plurality of cutting elements outwards and initiate cutting of the pipe; and retrieving the cut pipe.

* * * * *